US005248267A

United States Patent [19]

Weng

[11] Patent Number: 5,248,267

[45] Date of Patent: Sep. 28, 1993

[54] TELEPHONE JACK

[75] Inventor: Phil Weng, Taipei, Taiwan

[73] Assignee: Cal-Comp Electronics, Inc., Taipei, Taiwan

[21] Appl. No.: 733,719

[22] Filed: Jul. 22, 1991

[51] Int. Cl.[5] ..... H01R 23/02

[52] U.S. Cl. ..... 439/676; 439/686

[58] Field of Search ..... 439/676, 344, 638, 650–655, 439/686, 695, 696, 701

[56] References Cited

U.S. PATENT DOCUMENTS

| | | | |
|---|---|---|---|
| 4,290,664 | 9/1981 | Davis et al. | 439/676 |
| 4,408,819 | 10/1983 | Guelden | 439/638 |
| 4,497,526 | 2/1985 | Meyers | 439/676 |

*Primary Examiner*—David L. Pirlot

*Attorney, Agent, or Firm*—Jacobson, Price, Holman & Stern

[57] ABSTRACT

An improved telephone jack comprises an insertion entrance having two corresponding sockets arranged along the upper inner wall thereof and two corresponding brackets constructed at locations in opposite directions of the sockets. Each of the two brackets is composed of a check seat located at the upper end portion thereof. The insertion entrance further comprises two retaining portions located at the lower front end thereof to keep the telephone plug in a fixed position. The telephone jack further comprises a cable terminal body, which encloses therein a plurality of cables and comprises two check wings located at the front end thereof. When check wings are received fittingly in the sockets of the insertion entrance, the rear end portion of the cable terminal body is also accommodated properly on the check seats of the brackets so as to position securely the cable terminal body in place. The construction of the telephone jack is, therefore, significantly simplified and miniaturized by virtue of its lack of square seat body and receiving room which are integral parts of the conventional telephone jack of prior art.

4 Claims, 3 Drawing Sheets

TELEPHONE JACK

BACKGROUND OF THE INVENTION

The present invention relates to a telephone equipment, and more particularly to a telephone jack which is miniaturized.

Referring to FIG. 1, a conventional telephone jack of prior art is shown comprising a square seat body 1 having an insertion hole 11 disposed thereinto for permitting the plug 2 to be inserted into the seat body 1. Located at the upper portion of the seat body 1 is a connection portion 12 receiving a plurality of cables 13. A plurality of parallel slots 14 are constructed in the front end of the connection portion 12. In addition, the housing wall 3 comprises clamping side wall 311 which in turn forms a receiving room 31 to accommodate the square seat body 1. The size of the receiving room 31 can not be further reduced because of the consideration of specifications of the plug 2.

It is currently a popular tendency in electronic industry that an electronic product is designed in such a way that the size of the product is made as small as possible. By the same token, a telephone jack is no exception.

SUMMARY OF THE INVENTION

It is, therefore, the primary objective of the present invention to provide a telephone jack of miniature size.

It is another objective of the present invention to provide a telephone jack which is of a simplified construction and can be made at a low cost.

In keeping with the principles of the present invention, the primary objectives of the present invention are accomplished by a telephone jack comprising an insertion entrance having two corresponding sockets arranged along the upper inner wall thereof and two corresponding brackets constructed at locations in opposite directions of the sockets. Each of the two brackets is composed of a check seat located at the upper end portion thereof. The insertion entrance further comprises two retaining portions located at the lower front end thereof to keep the plug in a fixed position. In addition, the telephone jack further comprises a cable terminal body, which encloses therein a plurality of cables and comprises two check wings located at the front end thereof. When check wings are received fittingly in the sockets of the insertion entrance, the rear end portion of the cable terminal body is also accommodated properly on the check seats of the brackets so as to position securely the cable terminal body in place. Therefore, the structure of the telephone jack of the present invention is significantly simplified and miniaturized by virtue of its lack of square seat body and receiving room.

DETAILED DESCRIPTION OF THE PREFERRED EMBODIMENT

Figure 1:
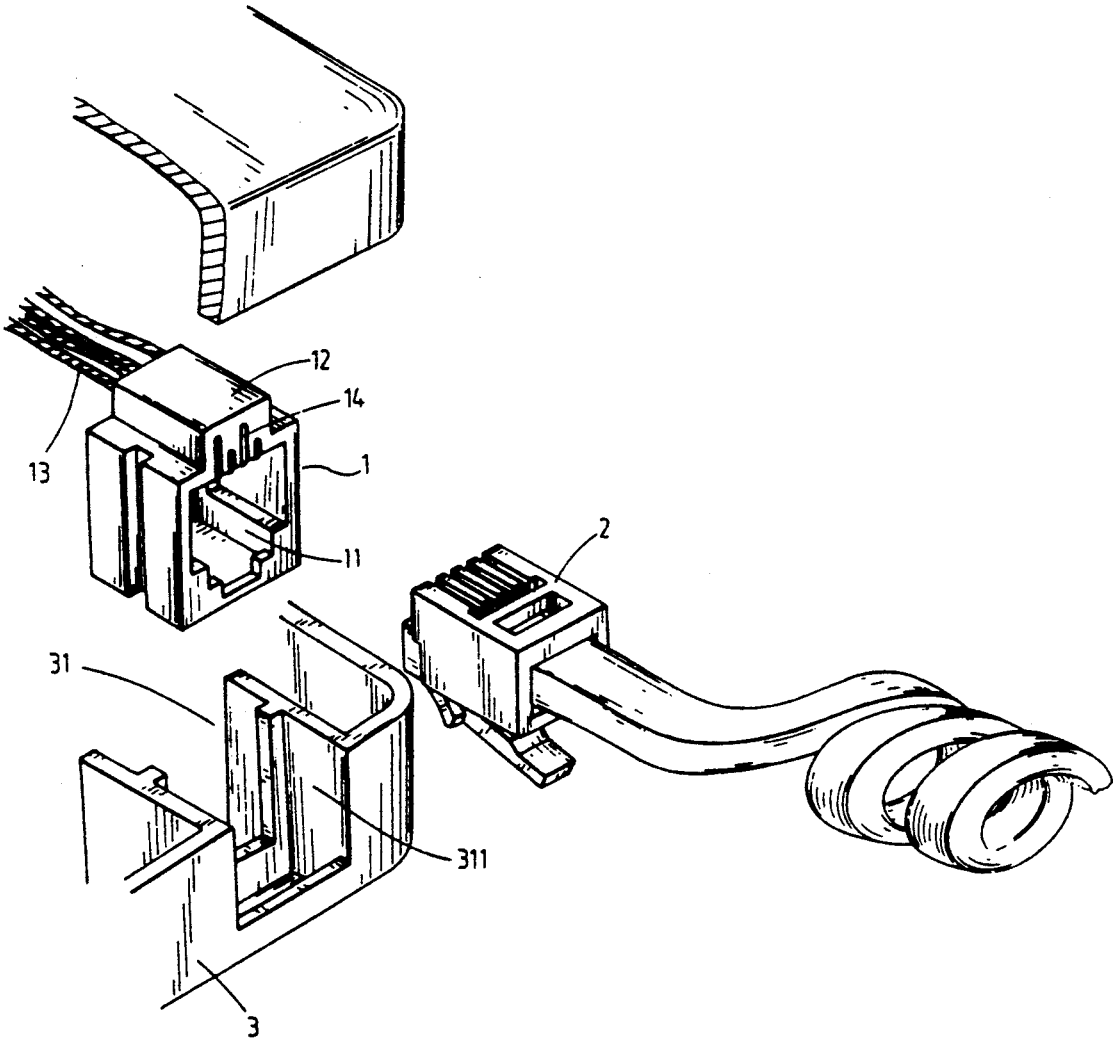
FIG. 1 shows a three-dimensional exploded view of a telephone jack of prior art.
Figure 2:
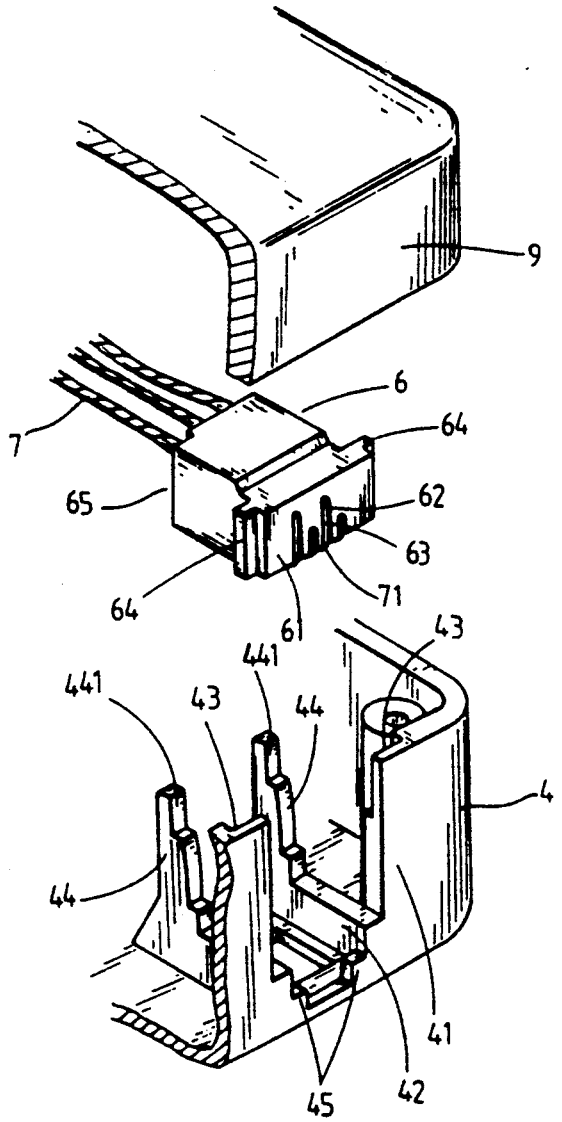
FIG. 2 shows a three-dimensional exploded view of a telephone jack of the present invention.
Figure 3:
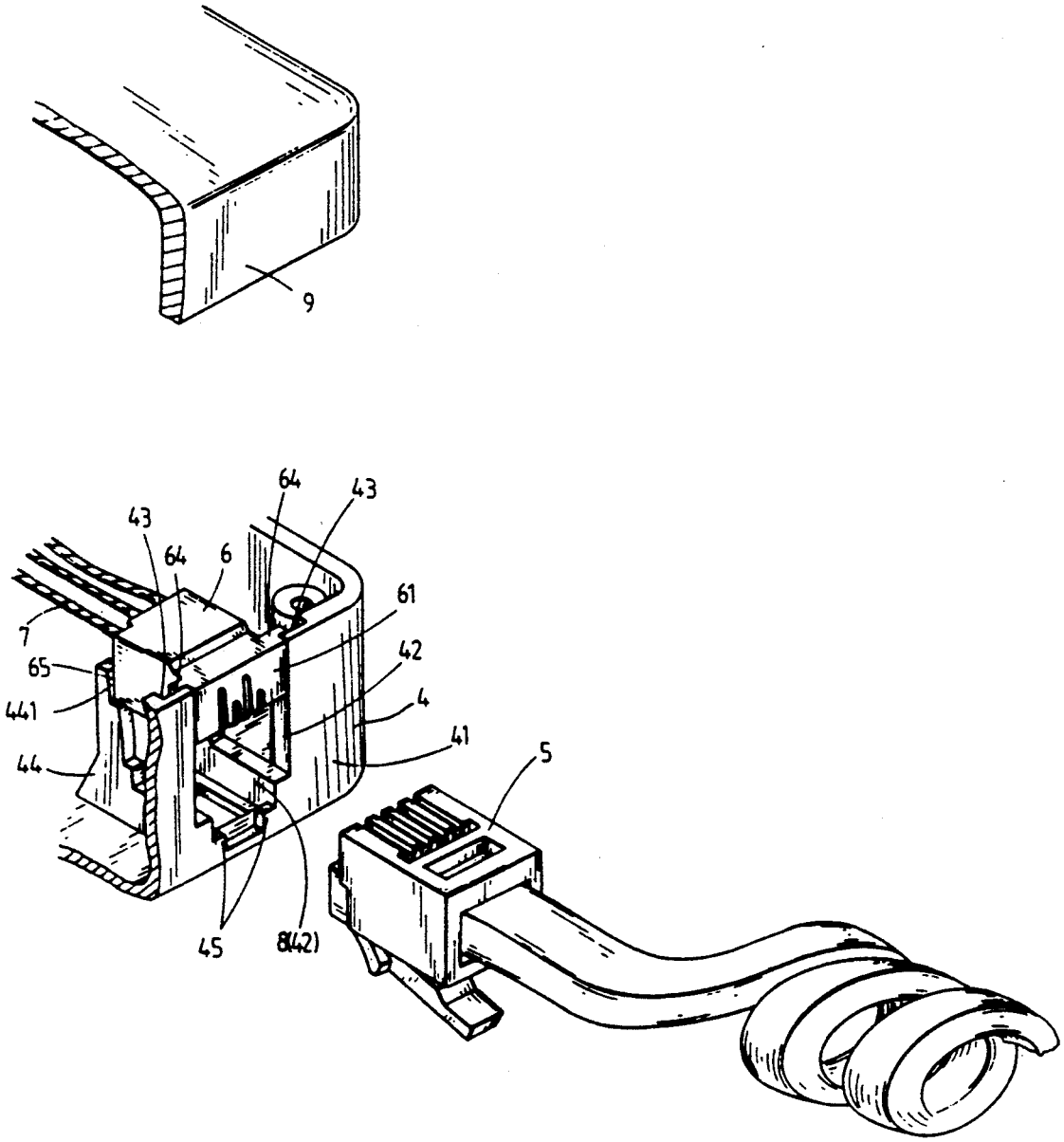
FIG. 3 shows a three-dimensional view of a telephone jack embodied in the present invention, with the cable terminal body being positioned in place.

Referring to FIGS. 2 and 3, the telephone jack housing 4 embodied in the present invention is shown comprising a front wall 41 having an insertion entrance 42 which corresponds to the telephone plug 5 in terms of configuration. The insertion entrance 42 is composed of two corresponding sockets 43 arranged along the upper inner wall thereof and two corresponding brackets 44 constructed at locations in opposite directions of the sockets 43. Each of the two brackets 44 is composed of a check seat 441 located at the upper end portion thereof. The insertion entrance 42 further comprises two retaining portions 45 located at the lower front end thereof to keep the plug 5 in a fixed position.

The telephone jack of the present invention further comprises a cable terminal body 6, which encloses therein a plurality of cables 7 and comprises two check wings 64 located at the front end thereof. The front face 61 of cable terminal body 6 consists of exit holes 62 permitting the cable cores 71 to emerge therefrom and of parallel slots 63 which correspond in number to the cable cores 71. Located at both sides of the front end of cable terminal body 6 are check wings 64 which are received fittingly in the sockets 43 so that front face 61 of cable terminal body 6 is in a perfect alignment with the outer wall surface of jack housing 4. The rear end portion 65 of cable terminal body 6 engages securely with check seats 441 of brackets 44 of jack housing 4. As a result of attachment of cable terminal body 6 to jack housing 4, there is an open space 8 remaining in the insertion entrance 42. The open space 8 permits the plug 5 to be inserted fittingly thereinto. The cable terminal body 6 is further confined by a jack cover 9 which is used to cap the jack housing 4.

It has become apparent from the foregoing description of the present invention that the construction of the telephone jack embodied in the present invention is significantly simplified and miniaturized by virtue of its lack of square seat body and receiving room which are integral parts of the conventional telephone jack of prior art. In addition, the telephone jack of the present invention has an advantage over the conventional telephone jack of prior art that it can be produced economically at a low cost.

The embodiment of the present invention described above is to be considered in all respects as merely an illustration of principles of the present invention. Accordingly, the present invention is to be limited only by the scope of the hereinafter appended claims.

What is claimed is:

1. An improved telephone jack comprising a telephone jack housing formed of a single piece having an insertion entrance defined by three sidewalls of said jack housing formed in a U-shape with sockets disposed within said jack housing for receipt of a cable terminal body, and a separate cable terminal body securely accommodated in said sockets.

said three sidewalls of said insertion entrance of said jack housing and a bottom surface of said cable terminal body forming a fourth closing side of an open space for engaging sidewalls of a telephone plug as said telephone plug is inserted in said open space to retain the telephone plug in said jack housing, one of said three sidewalls located opposite to said bottom surface of said cable terminal body including latch portions for engaging a complementary shaped portion of the telephone plug.

2. An improved telephone jack in accordance with claim 1, wherein said cable terminal body encloses therein a plurality of cables and includes two check wings located at a front end thereof, a front face of said cable terminal body includes exit holes permitting said cables to emerge therefrom and parallel slots corresponding in number to said cables, and said two check wings engage said sockets so that said front face of said cable terminal body is in alignment with an outer wall surface of said jack housing, and a rear end portion of said cable terminal body engages with said check seats.

3. An improved telephone jack in accordance with claim 1, wherein said insertion entrance is composed of two said sockets arranged along an upper wall of said insertion entrance and two brackets constructed at locations spaced from said sockets, each of said brackets including a check seat located at an upper end portion thereof, said cable terminal body is lodged in said open space and located between said sockets and said check seats, said insertion entrance further includes two retaining portions located at a lower front end thereof, and said insertion entrance and said cable terminal body are capped with a jack cover.

4. An improved telephone jack in accordance with claim 3, wherein said cable terminal body encloses therein a plurality of cables and includes two check wings located at a front end thereof, and a front face of said cable terminal body includes exit holes permitting said cables to emerge therefrom and parallel slots corresponding in number to said cables, and said two check wings engage said sockets so that said front face of said cable terminal body is in alignment with an outer wall surface of said hack housing, and a rear end portion of said cable terminal body engages with said check seats.

* * * * *